United States Patent [19]

Williams

[11] Patent Number: 4,976,003

[45] Date of Patent: Dec. 11, 1990

[54] CLEANING APPARATUS

[76] Inventor: William H. Williams, 4938 Golden Arrow Dr., Rancho Palos Verdes, Calif. 90274

[21] Appl. No.: 507,641

[22] Filed: Apr. 11, 1990

[51] Int. Cl.[5] ..... A47L 5/30; A47L 9/04

[52] U.S. Cl. ..... 15/372; 15/322; 15/392

[58] Field of Search ..... 15/392, 372

[56] References Cited

U.S. PATENT DOCUMENTS

| | | | |
|---|---|---|---|
| 2,614,283 | 10/1952 | Thornwald | 15/372 X |
| 3,639,941 | 2/1972 | Kirwan et al. | 15/372 |
| 3,802,026 | 4/1974 | Crener | 15/392 X |
| 4,139,922 | 2/1979 | Fitch | 15/372 X |
| 4,361,929 | 12/1982 | Jinkins | 15/392 X |

*Primary Examiner*—Chris K. Moore
*Attorney, Agent, or Firm*—Joseph E. Mueth

[57] ABSTRACT

In a vacuum cleaning apparatus of the dry, wet and wet/dry types having a cleaning head assembly, a rotatable brush carried within and spanning said head assembly adapted to loosen and agitate dirt on a surface to be cleaned, means for rotatably driving said brush, a dirt collection zone, and vacuum means communicating with the interior of said cleaning head assembly for sucking up dirt and carrying it to said dirt collection zone; the improvement comprising said brush being rotatable about a horizontal shaft, the shaft being carried at each of its ends by a movable shaft block, said shaft block being slidably received in a shaft block retainer case affixed to said cleaning head assembly, each of said shaft blocks being carried within its respective shaft block retainer case by resilient spring means biasing said shaft blocks and brush toward said surface to be cleaned, whereby each of said shaft blocks can independently slidably move upwardly within said shaft block retainer cases in response to variations in the surface or nap height of rug to be cleaned to automatically maintain contact between said brush and the surface to be cleaned.

11 Claims, 8 Drawing Sheets

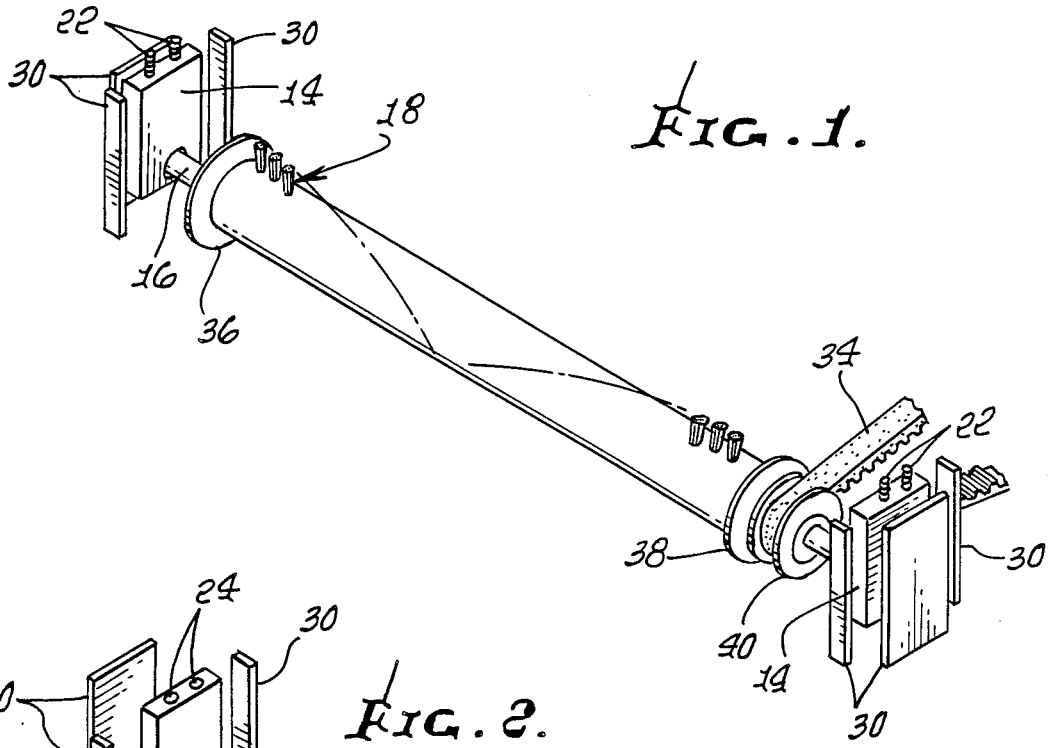
FIG. 1.
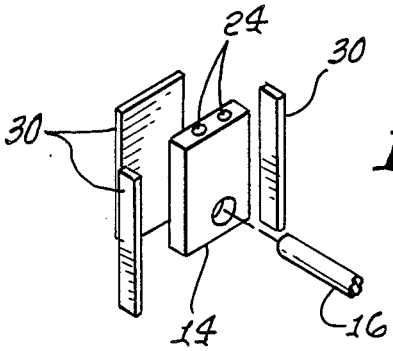
FIG. 2.
FIG. 4.
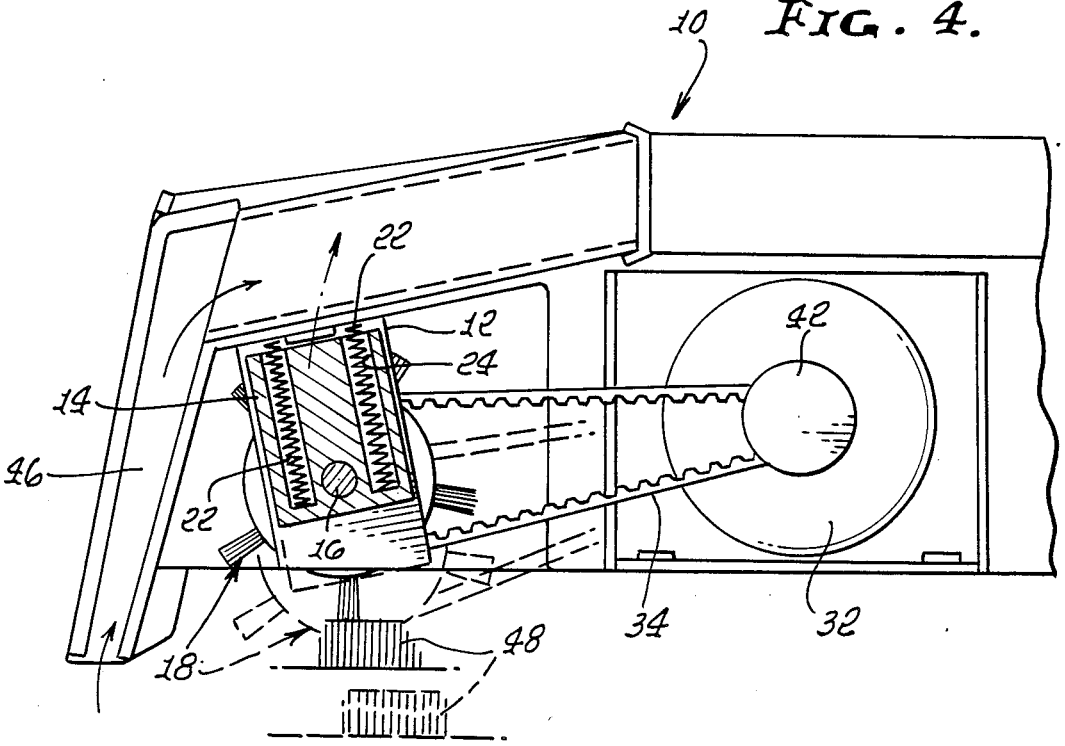

CLEANING APPARATUS

BACKGROUND OF THE INVENTION

U.S. Pat. No. 4,139,922 discusses a carpet cleaning device having self-adjustable brushes carried by a spring mounted stationary shaft intended to provide floating brush action within the frame of the device. The mounting springs push directly onto the ends of the brush shafts. The mounting springs are received within slots in the frame which results in objectionable noise of metal striking metal when bottoming out occurs. There is no disclosure of any independent vertical movement of one end of the brush with respect to the other end as in the present invention and no such action appears to be provided. In any case, this structure does not provide for smooth and consistent vertical sliding action at each end of the brush such as is provided by the device of the present invention. More particularly, U.S. Pat. No. 4,139,922 involves a complex and expensive double sprocket and chain system which is exposed and without shielding or other protection from corrosive cleaning solutions. In addition, the system is exposed to dirt and lint, the accumulation of which can rapidly jam the sprockets and chain drive. The chain drive, being exposed, may convey dirt and liquid to other parts of the unit, creating electrical problems.

U.S. Pat. No. 3,959,848 and U.S. Pat. No. 4,554,702 show disc brushes rotating about and floating up and down along vertical axes within a vacuum cleaner housing.

U.S. Pat. No. 3,802,026 discloses the use of springs to vertically bias an agitator in a dry vacuum cleaning apparatus. The construction permits up and down movement only of the agitator. No means are present in the apparatus to allow independent movement at the ends of the agitator. The apparatus is intended for dry use and it will not operate in a wet condition since slippage of the unprotected centerly located drive belt will occur in the event it becomes wet. Another particular problem with the apparatus is that as the agitator assembly moves up and down, the distance between the pulleys changes, thereby producing resistance to full up and down movement of the agitator, and stretching of the drive belt. The apparatus is also noisy, since the bottoming out of the sliding member causes an objectionable rattling.

U.S. Pat. No. 3,605,172 discloses a variable venture nozzle having two fixed parallel rollers with a channel therebetween to provide a variable channel width. While the irrelevance of this patent is readily apparent, it should be noted that the venture bar will significantly affect the vacuum motor performance, since it will restrict the opening and hence the air flow at the time when it is most needed. Lint collection on the venture bar and associate moving members are prone to fouling.

For many years vacuum cleaners have been provided with a rotatable brush which is intended to contact and brush the surface to be cleaned, to loosen and agitate dirt, grit, debris, etc., so that it can be sucked up into a collection tank or bag by a vacuum motor. The brush is able to perform its intended purpose only to the extent the distal ends of the bristles of the brush are in contact with the surface being cleaned. Keeping the brush in contact is not a problem provided the surface being cleaned is absolutely uniform, smooth and level. However, in many cases, the surface is irregular or bumpy. When this irregular surface condition exists, the efficiency of the brush is diminished, since only some of the bristles can contact the surface being cleaned. Other bristles do not reach the surface and hence are ineffectual in loosening or disturbing the dirt.

Various devices have been proposed in an effort to maintain contact between the brush and the surfaces being cleaned where that surface is irregular. For example, it has been proposed to provide a suspension system for the brush involving a plurality of support arms at each end of the brush, one end of each of the support arms being affixed to the cleaning head assembly and the other end being attached to the brush shaft through some intermediate structures. These proposed suspension systems which include bearings at the joints and motion limiting devices, are complicated and costly to manufacture, have proved to be unreliable in use, and ineffectual in keeping the brush in contact with many types of irregular surfaces.

Another problem with prior art devices has been that they produce irregular tension on the drive belt between the brush and the brush drive motor.

The present invention provides a significant advance in the art of vacuum cleaning apparatus. The brush is carried within the cleaning head assembly using simpler components, which are less costly and easier to manufacture. More importantly, the suspension system employed for the brush according to this invention maintains contact between the brush and the surface being cleaned over virtually any degree or extent of normal surface irregularity. The suspension system automatically adjusts the brush to accommodate irregularities and also to adjust for variations in nap height of rugs.

The present invention also maintains uniform tension in the drive belt between the brush and the brush drive motor over the full range of movement of the brush as it responds to surface irregularities.

It is believed that this invention provides a major improvement in the art and it is to be expected that it will be widely adopted by those skilled in the art.

SUMMARY OF THE INVENTION

Briefly, this invention comprehends a vacuum cleaning apparatus of the wet, dry and wet/dry types having a cleaning head assembly, a rotatable brush carried within and spanning said head assembly adapted to loosen and agitate dirt on a surface to be cleaned, means for rotatably driving said brush, a dirt collection zone, and vacuum means communicating with the interior of said cleaning head assembly for sucking up dirt and carrying it to said dirt collection zone; the improvement comprising said brush being rotatable about a horizontal shaft, the shaft being carried at each of its ends by a shaft block, said shaft block being slidably received in a shaft block retainer case affixed to said cleaning head assembly, each of said shaft blocks being carried within its respective shaft block retainer case by resilient spring means biasing said shaft blocks and brush toward said surface to be cleaned, whereby each of said shaft blocks can independently slidably move upwardly within said shaft block retainer cases in response to variations in the surface or nap height of rug to be cleaned to automatically maintain contact between said brush and the surface to be cleaned.

It is an object of this invention to provide an improved vacuum cleaning apparatus.

More particularly, it is an object of my invention to provide an improved suspension system for the rotatable brush of a vacuum cleaning apparatus able to operate in a wet or dry environment or both conditions in the same unit.

Still more particularly, it is an object of this invention to provide a structure which maintains contact between the brush and the surface to be cleaned over virtually any degree of surface variation, irregularity or rug nap height.

In another aspect, this invention provides for the movement of the brush with respect to its drive motor at a constant radius, thereby maintaining a uniform tension in the brush driving means over any range of movement of said brush.

These and other objects and advantages of this invention will be evident to those skilled in the art from the following more specific disclosure and the accompanying drawings.

DESCRIPTION OF PREFERRED EMBODIMENTS

The device and structure of my invention provide numerous advantages, among which are the following:

There is no necessity for manual adjustments for brush wear or nap type or height as with prior art units.

Since there is no fixed brush position in the device of my invention, the usual motor and belt overload problems associated with fixed brushes in prior art units is eliminated.

The automatic self-adjustment in the present invention provides extended life expectancy on drive motor, belts and associate parts.

The suspension system of my invention prevents overload conditions on drive belt and drive motor by automatically self adjusting to the best running position.

The bearings are protected against moisture and abrasion.

In the present invention, there is maximum brush agitation due to self-adjustment to floor irregularities and carpet nap type and height.

The full floating, automatic adjust suspension system of this invention produces a much improved brush agitation efficiency and thus speeds up the cleaning process.

Turning to the drawings:

FIG. 1 is a perspective view of the brush and the brush suspension system of this invention.

FIG. 2 is an exploded view of one end of the stationary brush shaft, shaft block and the slides which line the inside of the shaft block retainer case to facilitate slidable up and down movement of the shaft block within the shaft block retainer case.

FIG. 4 is an enlarged side view in partial breakaway, showing the side of the cleaning head assembly, the end of the shaft carrying the brush rotatable thereabout, the shaft block retainer case, the shaft block slidably received in the retainer case and, two springs which bias the shaft block shaft and brush downwardly while permitting upward movement in response to force applied to the brush as it contacts height irregularities on the surface being cleaned. As is shown, the brush can move radially with respect to the motor to maintain constant tension on the motor drive belt.

Figure 3:
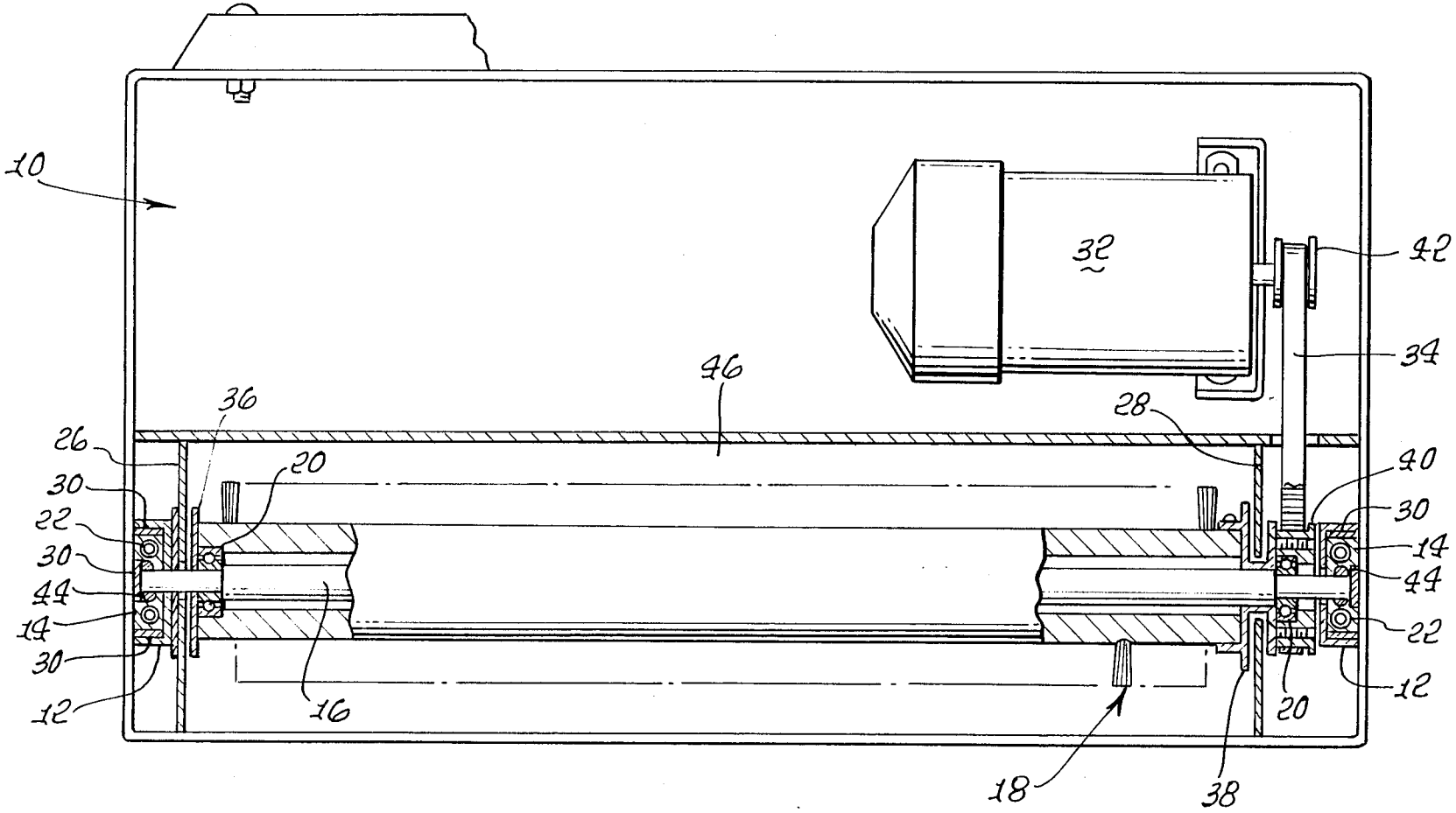
FIG. 3 is a top plan view in partial section of the brush assembly of this invention.
Figure 5:
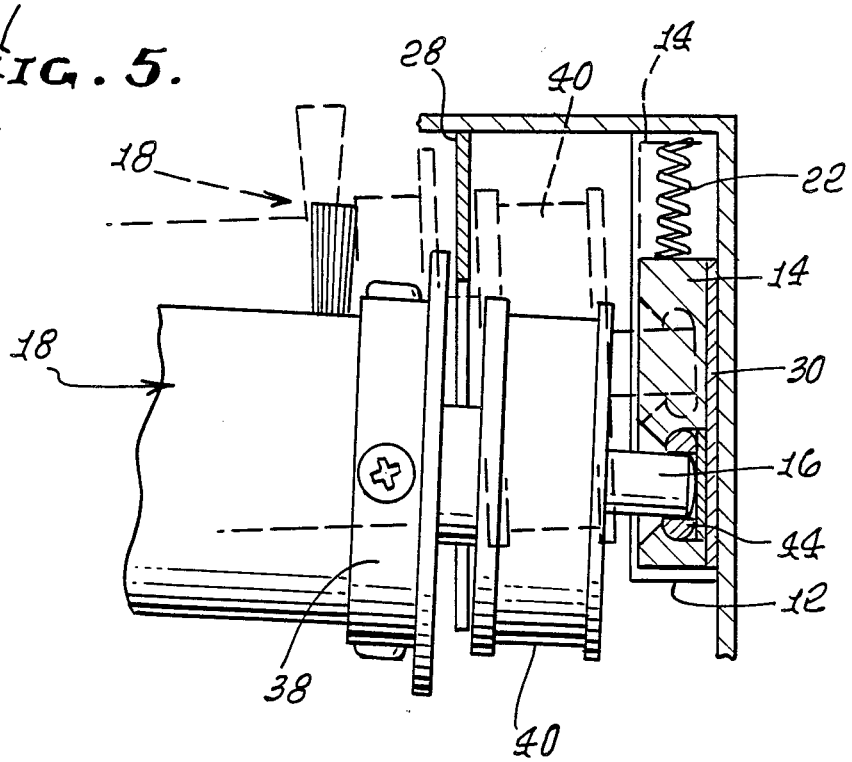

FIG. 5 is a schematic front view of one end, the pulley end, of the brush assembly, showing the upward angular range of movement of the end brush in response to the force of surface irregularity at that end.

Figure 6:
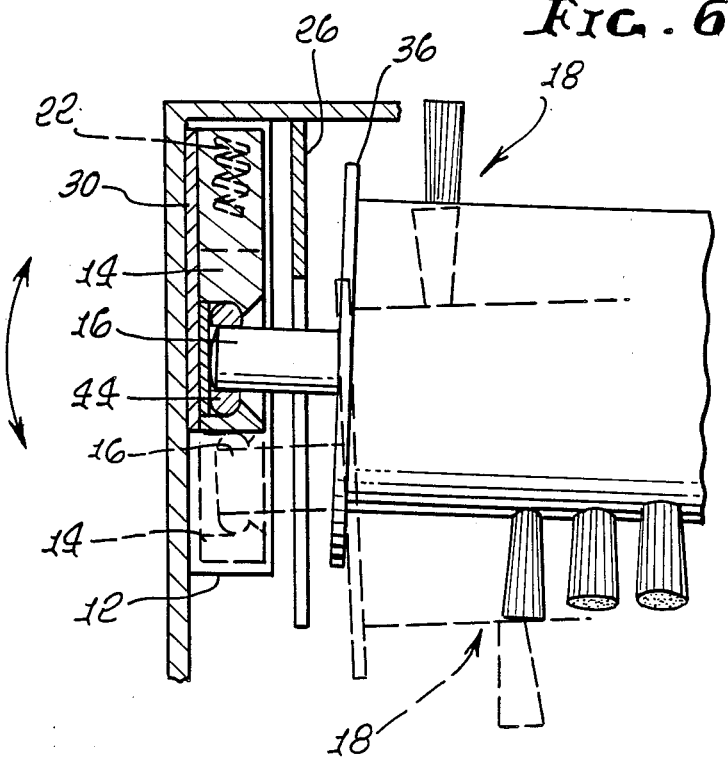

FIG. 6 is a schematic front view of the other end of the brush assembly showing the upward angular range of movement which can occur when the surface irregularity causes upward force at that end of the brush.

Figure 7:
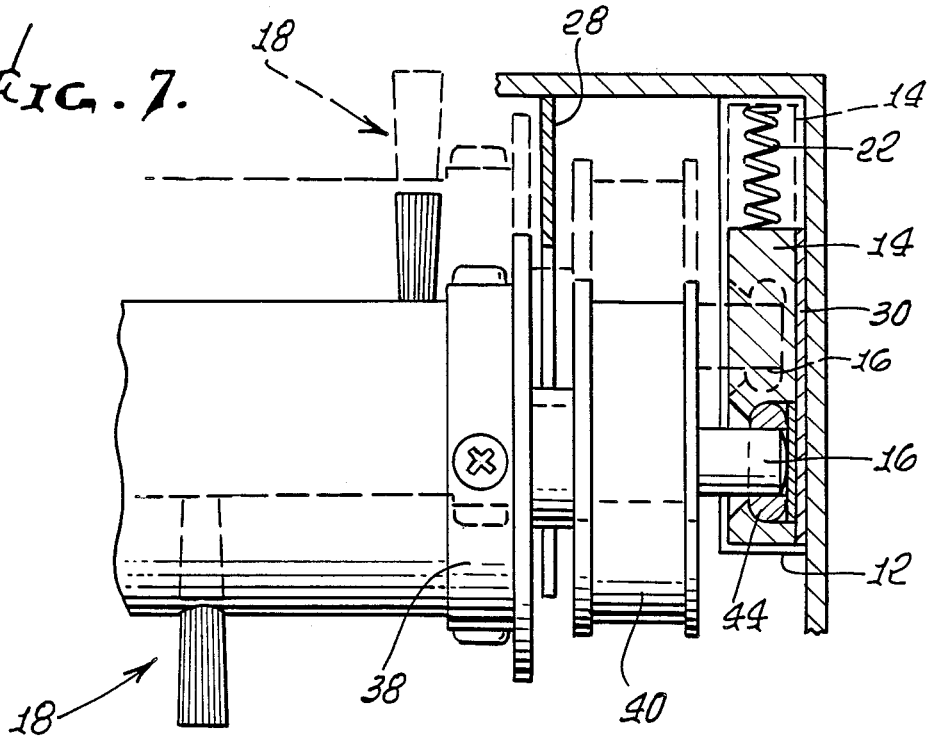

FIG. 7 is similar to FIG. 5 and shows the pulley end, specifically, the range of pure up and down movement, where there is no difference in the upward forces applied to the ends of the brush and hence no angular movement.

Figure 8:
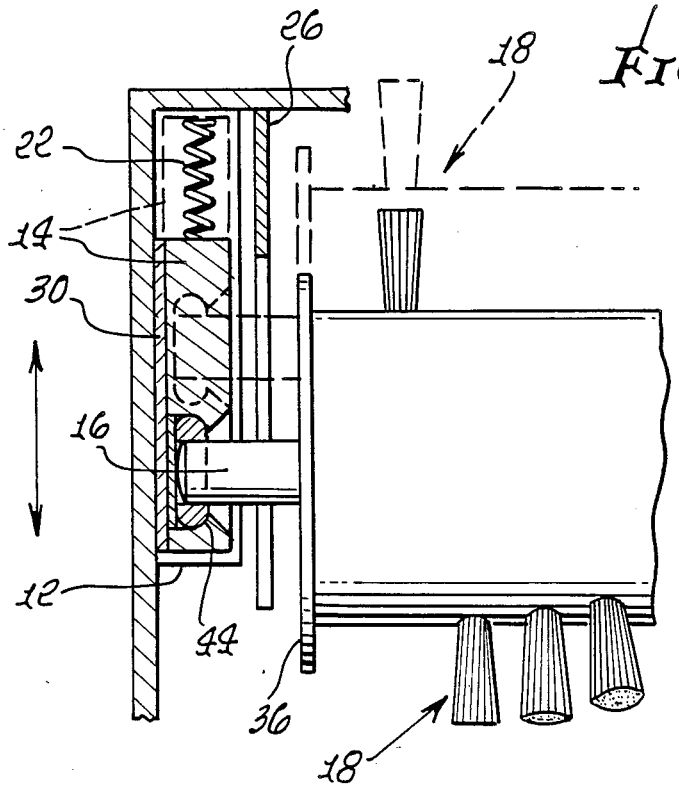

FIG. 8 is similar to FIG. 6 and shows pure up and down movement at that end.

Figure 9:
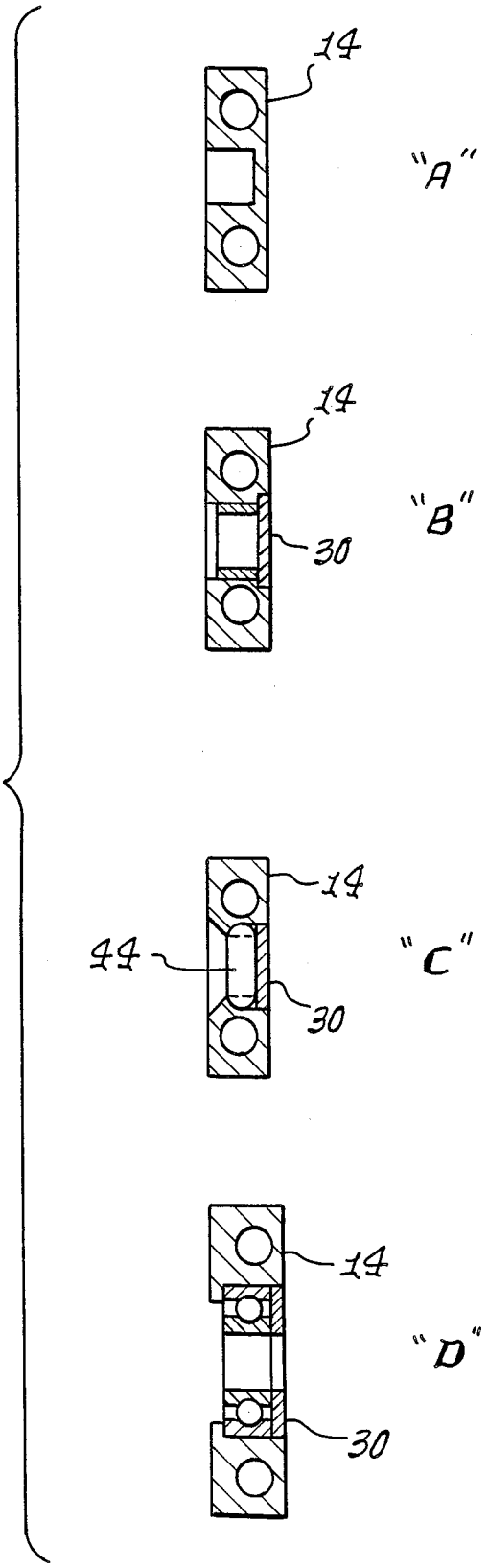

FIG. 9 shows schematic drawings of several combinations of sliding shaft blocks in conjunction with various shaft bearing configurations, all within the contemplation of this invention.

Considering FIGS. 1 to 8 of the drawings in more detail, the vacuum cleaning head assembly 10 is adapted to ride on the surface to be cleaned, normally a floor. The head assembly 10 has affixed thereto the shaft block retainer cases 12 in which the shaft blocks 14 are slidably received. The brush shaft 16 is slip fitted into shaft blocks 14. The brush 18 is rotatably carried by the stationary brush shaft 16 on ball bearings 20. The pair of coil springs 22 are permanently retained by the shaft blocks retainer cases 12. The other end of each of springs 22 is retained in the slidable shaft blocks 14. Specifically, the springs 22 are received in blind holes 24 within slidable shaft blocks 14.

The protective walls 26 and 28 at each end shield and protect, as is more full explained below, and provide an enclosure or compartment in which the brush rotates, serving to contain the water or other cleaning fluid.

The shaft block retainer cases 12 are lined at each of three sides with solid self lubricating material such as, but not limited to, teflon slide elements 30 to facilitate lubrication and minimize friction and wear during the up and down movement of the brush, shown in FIGS. 1 to 4, in response to the brush coming into contact with irregularities in the surface or nap of the rug being cleaned.

The brush 18 is driven by brush drive motor 32 via a timing belt 34. As can be seen from the drawings, the brush 18 moves in a perfect constant radius with respect to the brush drive motor 32, maintaining constancy of tension in the drive motor and resulting in more satisfactory operation, longer life and no slippage.

The brush 18 has a solution slinger and string guard combination 36 and 38 on each end.

The timing belt 34 runs over the rotary brush pulley 40 and the brush motor pulley 42.

Ball joints 44 are provided within the shaft blocks 14 and receive the ends of brush shaft 16. The function of the ball joints 44 in allowing independent movement of shaft 16 and brush 18 is discussed in more detail hereinbelow.

The brush chamber 46 is in communication with a conventional vacuum motor and dirt collection zone (tank or bag), not shown in the drawings.

The protective walls 26 and 28 shield the timing belt 34, rotary brush pulley 40, and the bearings from contact with cleaning solution and dirt.

In operation, as the brush contacts the surface 48 to be cleaned, the brush can move as shown in FIGS. 4 to 8. An important feature is that each side of the brush and its associated shaft block can move independently of the other in response to irregularities on the surface being cleaned. When little or no upward pressure on the brush exists, the shaft blocks 14 are biased to maintain the shaft blocks 14 in the down position. As pressure is applied to the brush 18 by irregularities in the surface 48 (or variation in the nap height of a rug), the bias of the springs 22 is partially overcome, the springs partially compress, and the shaft blocks carrying the shaft 16 and brush 18 move upwardly within the shaft block retainer cases 12, as indicated by the direction of the arrow in FIG. 4. The extent of compression of one pair of springs 22 and the movement of its associated shaft block 14 is independent of the extent of compression and movement which occurs at the opposite end of the brush so that the brush may tilt within the cleaning head assembly in response to a surface irregularity which is greater at one end of the brush.

Considering the operation of the device of the present invention under varying circumstances, it can be seen from FIGS. 5 and 6 how the ends of the brush and brush blocks are able to move independently by virtue of the brush shaft being received in the ball joint. The one end of the brush shaft can be up while the other end is down. FIGS. 6 and 7 show the ends of the brush and brush blocks moving up and down together, that is, vertical movement is equal and simultaneous at both ends.

The "C" embodiment of FIG. 9 shows the ball joint, the operation and assembly of which is described in great detail in FIGS. 1 to 8.

The "A" embodiment of FIG. 9 simply shows a slidable shaft block for receiving a stationary brush shaft.

The embodiments of FIG. 9, "B" and "D," involve an alternative arrangement wherein the brush is carried on a shaft which rotates with the brush. The shaft is carried by sleeve ("B") or ball bearings ("D") within the sliding shaft block.

It is to be particularly noted that in all of these embodiments, the bearings are well protected from both moisture and grit, and hence are not subject to rusting conditions and abrasion damage.

The present invention is adapted to the full range of vacuum cleaning devices, including dry, wet, and wet/dry systems, canister types, large industrial units, and small hand-held portable devices.

Having fully described the invention, it is intended that it be limited solely by the lawful scope of the appended claim.

I claim:

1. In a vacuum cleaning apparatus of the dry, wet and wet/dry types having a cleaning head assembly, a rotatable brush carried on a stationary horizontal shaft within and spanning said head assembly, said brush being adapted to loosen and agitate dirt on a surface to be cleaned, means for rotatably driving said brush, a dirt collection zone, and vacuum means communicating with the interior of said cleaning head assembly for sucking up dirt and carrying it to said dirt collection zone, the improvement comprising said rotatable brush being movable toward and upwardly from said surface to be cleaned independently at each of its ends within said head assembly in response to variations in the surface or nap height of rug to be cleaned to automatically maintain contact between said brush and the surface to be cleaned and including sliding shaft blocks at each end of said shaft, said sliding shaft blocks being carried by resilient spring means connected to said head assembly and said sliding shaft blocks being vertically slidable with respect to said head assembly.

2. The apparatus of claim 1 wherein the horizontal shaft is stationary and the brush is rotatable thereon.

3. The apparatus of claim 1 wherein the horizontal shaft rotates together with the brush.

4. The apparatus of claim 1 wherein the horizontal shaft is received in a ball joint in said sliding shaft blocks.

5. The apparatus of claim 1 wherein said means for rotatably driving said brush includes a brush drive motor and a timing belt connecting said motor to rotate said brush, and said improvement further comprises means for movement of said brush with respect to said brush motor at a constant radius, thereby maintaining a uniform tension in said timing belt over any range of movement of said brush, and wherein said timing belt prevents slipping.

6. The apparatus of claim 1 wherein each said shaft block is contained within a retainer case which is lined with teflon or equivalent solid lubricating material to facilitate sliding of said shaft block within said retainer case.

7. The apparatus of claim 1 wherein said resilient spring means comprise coil springs.

8. In a vacuum cleaning apparatus having a cleaning head assembly, a rotatable brush carried within and spanning said head assembly adapted to loosen and agitate dirt on a surface to be cleaned, means for rotatably driving said brush, a dirt collection zone, and vacuum means communicating with the interior of said cleaning head assembly for sucking up dirt and carrying it to said dirt collection zone; the improvement comprising said brush being rotatable about a horizontal shaft, the sliding shaft being carried at each of its ends by a sliding shaft block, said shaft block being slidably received in a shaft block retainer case affixed to said cleaning head assembly, each of said sliding shaft blocks being carried within its respective shaft block retainer case by resilient spring means biasing said sliding shaft blocks and brush toward said surface to be cleaned, whereby each of said sliding shaft blocks and brush can independently slidably move within said shaft block retainer cases in response to variations in the surface to be cleaned to automatically maintain contact between said brush and the surface to be cleaned.

9. The apparatus of claim 8 wherein said means for rotatably driving said brush includes a brush drive motor and a drive belt connecting said motor to rotate said brush, and said improvement further comprises means for movement of said brush with respect to said brush motor at a constant radius, thereby maintaining a uniform tension in said drive belt over any range of movement of said brush.

10. The apparatus of claim 8 wherein said shaft block retainer case is lined with solid self-lubricating material such as, but not limited to, teflon to facilitate sliding of said shaft block within said retainer case.

11. The apparatus of claim 8 wherein said resilient spring means comprise coil springs.

* * * * *